United States Patent [19]

Wiese et al.

[11] 4,394,111

[45] Jul. 19, 1983

[54] TOP COVER, MOTOR, FAN AND FAN SHROUD ASSEMBLY FOR AN AIR CONDITIONING UNIT

[75] Inventors: John M. Wiese, Red Bud; Russell W. Hoeffken, Belleville, both of Ill.

[73] Assignee: Snyder General Corporation, Red Bud, Ill.

[21] Appl. No.: 301,080

[22] Filed: Sep. 11, 1981

[51] Int. Cl.[3] ..... F28F 13/12; F04B 35/04; F04D 29/54

[52] U.S. Cl. ..... 417/360; 417/424; 415/219 R; 165/122

[58] Field of Search ..... 415/219 R, 121 G; 416/247 R; 417/360, 424; 165/76, 122, 125

[56] References Cited

U.S. PATENT DOCUMENTS

| | | | |
|---|---|---|---|
| 1,981,424 | 11/1934 | Lake . | |
| 2,812,703 | 11/1957 | Tobey | 417/424 |
| 3,093,189 | 6/1963 | Panthofer | 165/122 X |
| 3,858,644 | 1/1975 | Beck et al. | 165/122 X |
| 4,036,292 | 7/1977 | Hine, Jr. | 165/122 |
| 4,043,708 | 8/1977 | Greenfield | 165/122 X |
| 4,055,113 | 10/1977 | Monroe | 417/424 X |
| 4,185,688 | 1/1980 | Wiater et al. | 165/122 |
| 4,191,245 | 3/1980 | Wendt et al. | 165/76 X |
| 4,202,409 | 5/1980 | Cann et al. | 165/122 |

FOREIGN PATENT DOCUMENTS

| | | | |
|---|---|---|---|
| 2233737 | 1/1973 | Fed. Rep. of Germany | 165/122 |
| 56-138630 | 10/1981 | Japan | 165/76 |

*Primary Examiner*—Leonard E. Smith

*Attorney, Agent, or Firm*—Hubbard, Thurman, Turner & Tucker

[57] ABSTRACT

A top cover, motor, fan and fan shroud for an air conditioning unit are assembled into an integrated structure with motor supporting legs which attach to the top cover and cause the shroud to be drawn against the cover. The legs connect with the shroud in a manner serving to preserve the concentricity of the shroud, and attach to the inside of a band which can be tightened to assure containment of the motor in a defined position under the shroud and vented portion of the cover.

10 Claims, 9 Drawing Figures

TOP COVER, MOTOR, FAN AND FAN SHROUD ASSEMBLY FOR AN AIR CONDITIONING UNIT

DESCRIPTION

BACKGROUND OF THE INVENTION

1. Field of the Invention

The invention relates to air conditioning units, and more particularly to an assembly therefor of a top cover, motor, fan and fan shroud.

2. Description of the Prior Art

Heretofor, various means have been employed to mount a motor and shroud for a fan driven by the motor in an air conditioning unit. In one arrangement, shown in U.S. Pat. No. 4,202,409 of Peter L. Cann for "One Piece Top Cover with Stamped Open Louvers and Motor Mount" issued May 13, 1980, the motor is secured to the top cover of an air conditioning unit at a center section which is where the cover is least suited to support the weight of the motor and to resist the transmission of motor induced vibrations to the entire cover. In another arrangement shown in U.S. Pat. No. 4,171,937 of John B. Greenfield for "Grill Panel and Motor Mount Assembly" issued Oct. 23, 1979, a bracket assembly and cables are employed to mount a fan motor on the top panel of an air conditioning unit. The fan is without a shroud for efficiently controlling the flow of air. U.S. Pat. No. 4,036,292 of Louis P. Hine, Jr. for "Refrigeration Condenser" issued July 19, 1977 shows an air conditioning unit wherein a fan motor is supported on vibration prone ribs in the top cover of an air conditioning unit and a shroud for the fan is an integral part of the housing of the air conditioner.

It is a prime object of the present invention to structurally integrate a top cover, motor, fan and fan shroud for an air conditioning unit into an easily fabricated assembly which is without the deficiencies present in prior arrangements.

Various specific objectives and advantages of the invention will become apparent during a reading of the specification taken in connection with the accompanying drawings.

SUMMARY OF THE INVENTION

The vented top cover of an air conditioning unit is provided with a depending cylindrical shroud in communication with the said vent, a fan and a fan driving motor having axes in common with the axis of the shroud, motor supporting legs which are connected to the shroud and have upper end flanged portions in substantially the same plane as the upper edge of the shroud, and means for simultaneously fastening said upper end flanged portions of the motor supporting legs to the top cover and drawing the upper edge of the shroud snuggly against the cover. The shroud and motor supporting legs are fabricated from sheet metal and the legs are provided with lower end flanges for attachment to the inside surface of a band which can be tightened about the motor casing to secure the motor to the legs.

DESCRIPTION OF THE PREFERRED EMBODIMENT OF THE INVENTION

Figure 1:
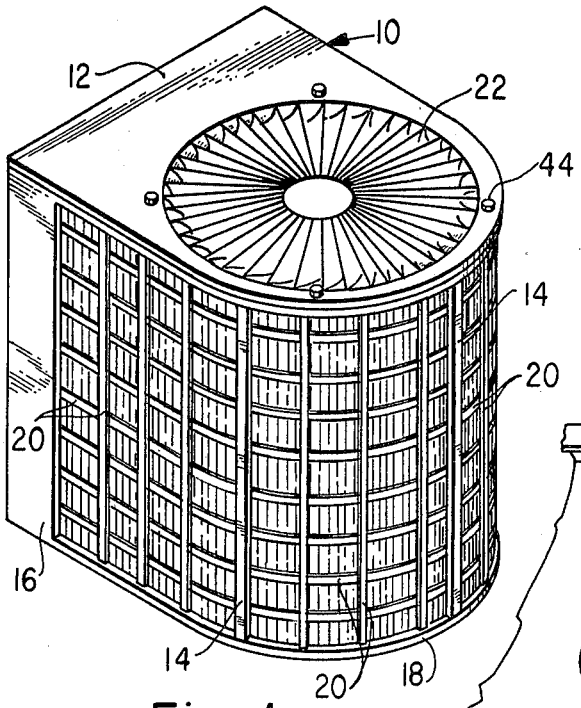
FIG. 1 is a perspective view of an air conditioning unit incorporating the assembly of the invention.
Figure 2:
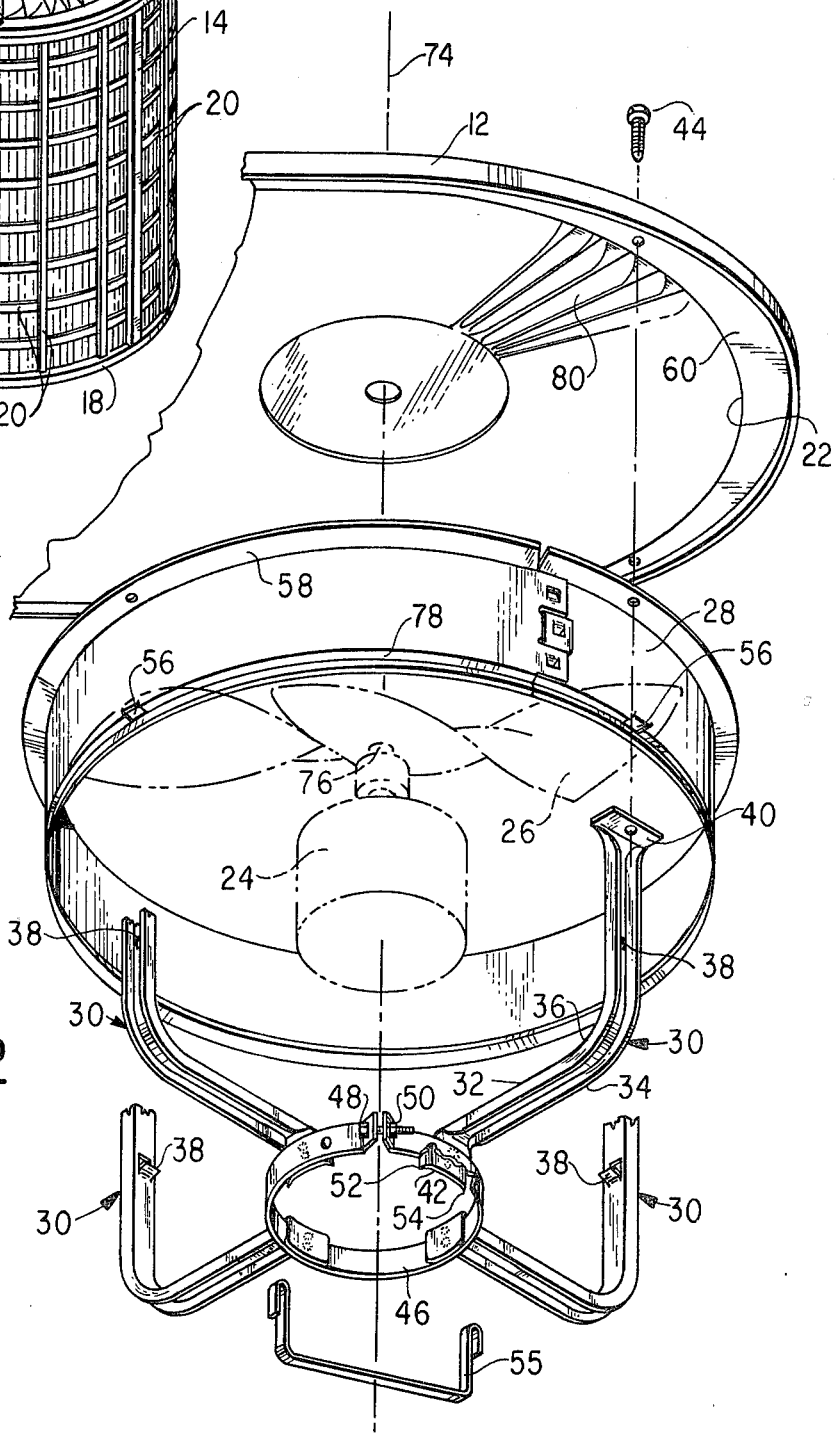
FIG. 2 is an exploded perspective view of the assembly of the invention.
Figure 5:
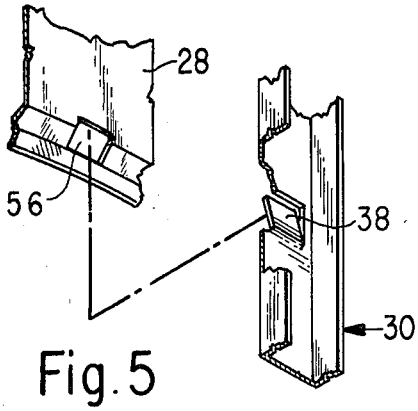
FIG. 5 is a fragmentary perspective view showing cooperating parts of a motor supporting leg and shroud.
Figure 3:
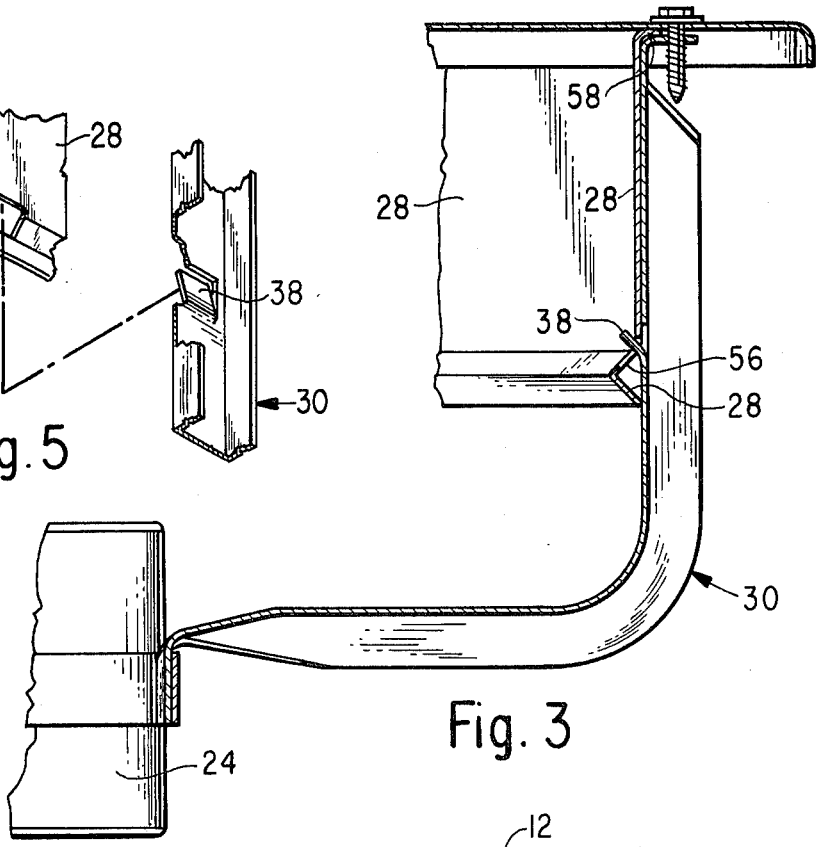
FIG. 3 is a vertical sectional view taken through a motor supporting leg of the assembly.
Figure 4:
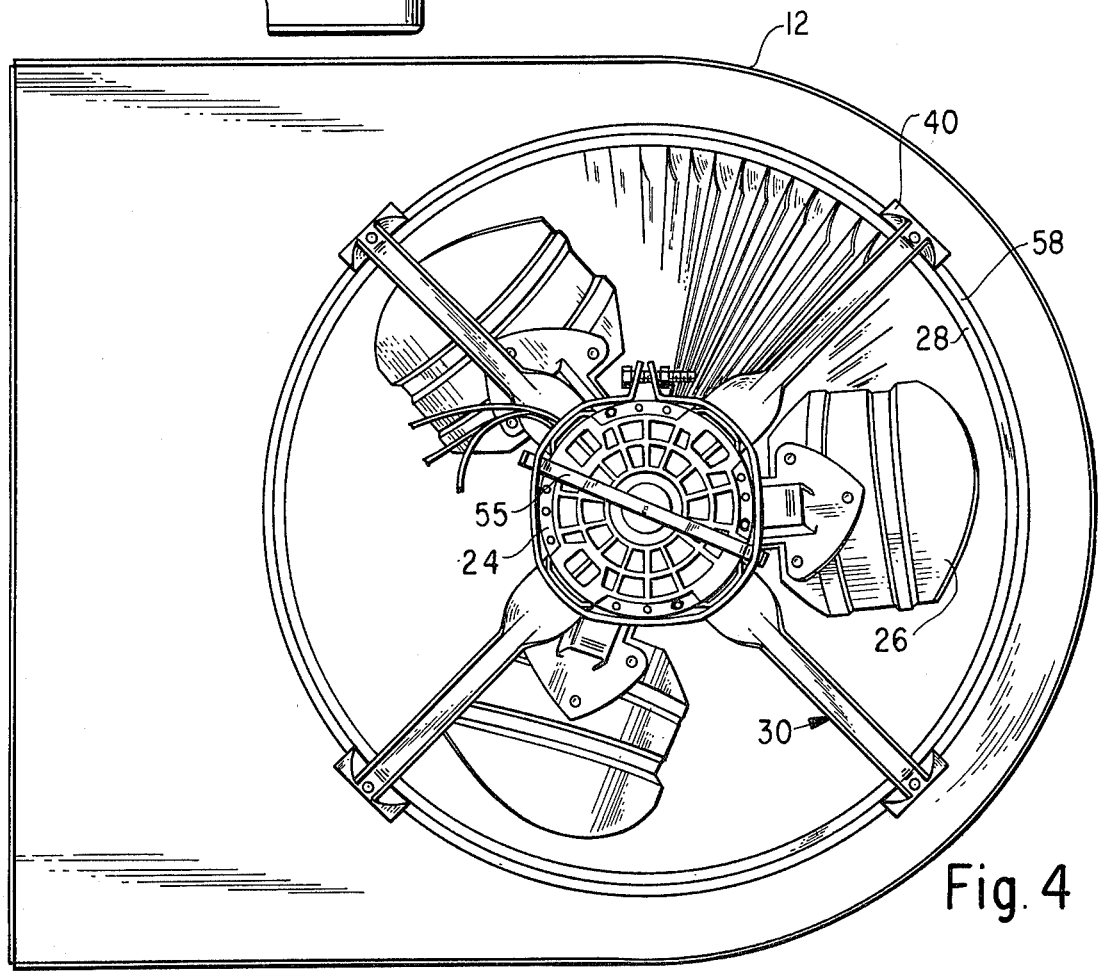
FIG. 4 is a bottom view of the assembly.

Referring to the drawings, reference character 10 designates an outdoor air conditioning unit having a top cover 12 which is supported on struts 14 and corner posts 16 extending upright from a base 18. Air flows into the unit through open mesh side coil guards 20 and out of a circular louvered vent 22 in the cover. A motor 24, fan 26 rotatable by the motor, a cylindrical shroud 28, and top cover 12 are structurally integrated into an assembly in accordance with the invention.

As shown, a plurality of legs 30 interconnect the motor 24, shroud 28 and top cover 12. Each leg 30 is formed with stiffening side flanges 32 and 34, and with a right angle bend 36. Each leg is also formed with an angularly projecting tab 38 and with opposite end flanges 40 and 42. Flanges 40 are secured to top cover 12 by screws 44 which extend through the cover and are threaded into the flanges whereas the flanges 42 are secured as by spot welding to a metal band 46 which is wrapped around the casing of motor 24 and tightened thereon with a bolt 48 extending through end portions of the band, and a nut 50 on the bolt.

Each of the leg flanges 42 extends under band 46 and remains entrapped between the band and motor casing if the spot welding connection between the band and leg should fail. The loss of motor containment such as would occur with the flange secured to the outer surface of the band is therefor prevented. The leg flanges 42 are formed to extend in a slight arc over the surface of the motor casing and are provided with sharp edges 52 and 54 which serve to penetrate any painted coating on the surface of the motor casing when band 46 is tightened, and so ground the motor without the need for a special grounding wire. A metal strap 55 which hooks over metal band 46 and extends under the motor casing helps to vertically support the motor.

Legs 30 connect with shroud 28 at the tabs 38 which extend into apertures 56 spaced about the shroud for alignment with the tabs. When the legs 30 and shroud are so connected an edge lip 58 of the shroud is in substantially the same plane as flanges 40. Therefor, when leg flanges 40 are secured to top cover 12 with screws 44, the tabs 38 by engagement with the shroud cause the shroud to be moved toward the cover and upper lip 58 of the shroud to be drawn snuggly against under surface 60 of the cover. In addition, the tabs help it maintain concentricity of the shroud and to prevent the legs from being moved by motor start up torque.

Figure 6:
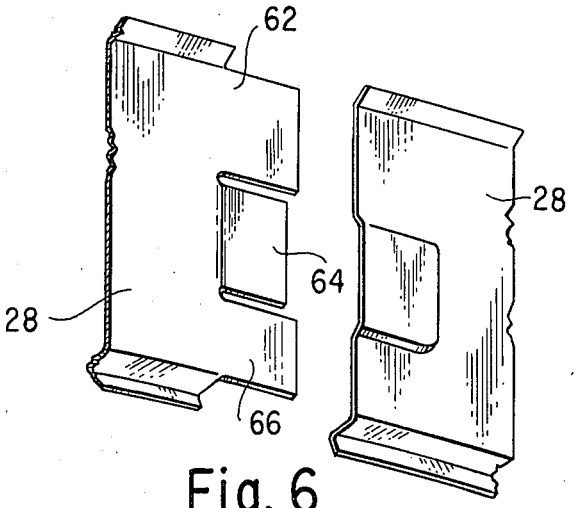
FIG. 6 is a fragmentary perspective view showing complementary parts of the shroud before being attached one to the other.
Figure 7:
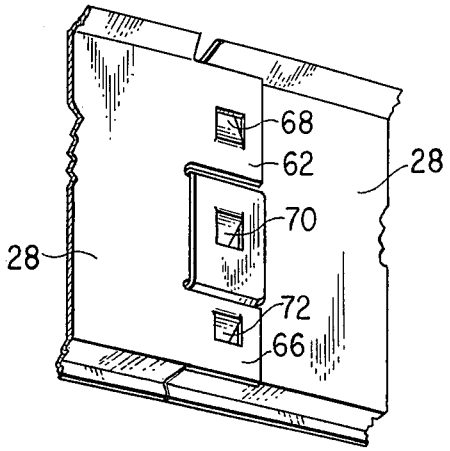
FIG. 7 is a view similar to FIG. 6 showing the complementary parts attached.
Figure 8:
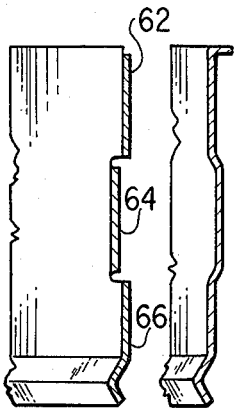
FIG. 8 is a vertical sectional view taken through the complementary parts of the shroud before being attached.
Figure 9:
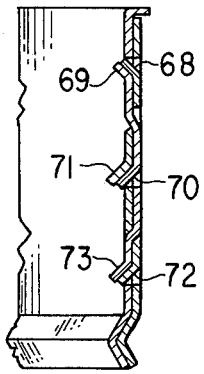
FIG. 9 is a view similar to FIG. 8 showing the complementary parts attached.

Shroud 28 is formed from a rolled sheet metal strip provided with tongues 62, 64 and 66 at one end adapted at the other end to receive the tongues (see FIGS. 6 and 8). The strip is curled into a circle and adjacent tongues at said one end are disposed on opposite sides of the other end of the strip. The end portions of the strip are press fitted for concentricity in a die, and at the same time tab pairs 68–69, 70–71 and 72–73 are passed out of the material to interlock the ends of the strip (see FIGS. 7 and 9).

The shroud in its secured position under top cover 12 has its axis 74 in common with the rotational axes of the motor 24, and the fan 26 on the upwardly extending shaft 76 of the motor, and all such axes extend through the center for circular vent 22 in the cover. As shown, shroud 28 includes a V-shaped groove 78 which projects inwardly toward the said axes. The groove, which is located at about the level of shroud apertures 56 wherein the leg tabs 38 extend, stiffens the shroud and so serves to preserve its concentricity. Such groove also permits air to flow radially as well as axially into the shroud and to expand beyond the groove on the way to vent 22. Air flow through the air conditioning unit is thereby enhanced and better performance is realized. Although it is preferable to have louvers 80 in vent 22, these aren't essential to the construction of the invention. The vent in cover 12 may, for example, be devoid of any air deflecting means, in which case a wire fan guard or the equivalent would be placed over the vent and secured to the cover.

It is to be understood that the present disclosure relates to a preferred embodiment of the invention which is for purposes of illustration only, and is not to be construed as a limitation of the invention. Numerous alterations and modifications of the structures herein disclosed will suggest themselves to those skilled in the art, and all such modifications and alterations which do not depart from the spirit and scope of the invention are intended to be included within the scope of the appended claims.

We claim:

1. In an air conditioning unit, a top cover with a vent for the passage of air, a depending cylindrical shroud in communication with said vent, a fan and a motor for driving the fan having axes in common with the axis of the shroud, motor supporting legs which are connected to the shroud and have end flanged portions in substantially the same plane as the upper end of the shroud, and means for simultaneously fastening said flanged portions of the motor supporting legs to the top cover and drawing the upper end of the shroud snugly against the cover.

2. The combination of claim 1 wherein the shroud is a sheet metal part with spaced apertures therearound, and the motor supporting legs are formed sheet metal parts with tabs thereon which extend into said apertures to connect the legs and shroud.

3. The combination of claim 1 wherein the shroud is a curled sheet metal part with interlocked end parts.

4. The combination of claim 1 wherein the shroud is a sheet metal part with an inwardly projecting V-shaped circular ridge near the bottom edge thereof.

5. The combination of claim 1 wherein the shroud is a sheet metal part with an inwardly projecting V-shaped circular ridge near the bottom edge thereof and with spaced apart apertures in close proximity to the ridge, the motor supporting legs are formed sheet metal parts with tabs thereon and such tabs extend into said apertures to connect the legs and shroud.

6. The combination of claim 1 wherein the motor has a band wrapped therearound, the motor supporting legs include flanges which are spot welded to the inside of the band, and means are provided for tightening the band on the motor.

7. The combination of claim 1 wherein the motor has a band wrapped therearound, the motor supporting legs include flanges which are affixed to the inside of the band, means are provided for tightening the band on the motor, and the flanges on the motor supporting legs include sharp edges for making metal to metal contact with the motor through any coatings on the engaging parts.

8. The combination of claim 1 wherein the motor has a band wrapped therearound, the motor supporting legs are affixed to the band, and means are provided for tightening the band on the motor.

9. The combination of claim 8 wherein the legs are affixed to the inside of the motor band.

10. The combination of claim 8 wherein the band tightening means comprises a bolt extending through the band, and a nut on the bolt.

* * * * *